US012102147B2

(12) United States Patent
Lim

(10) Patent No.: US 12,102,147 B2
(45) Date of Patent: Oct. 1, 2024

(54) LIQUID PROOF GLOVES HAVING IMPACT PROTECTION

(71) Applicant: RINGERS TECHNOLOGIES LLC, Houston, TX (US)

(72) Inventor: Hardy Lim, Spring, TX (US)

(73) Assignee: RINGERS TECHNOLOGIES LLC, Houston, TX (US)

( * ) Notice: Subject to any disclaimer, the term of this patent is extended or adjusted under 35 U.S.C. 154(b) by 392 days.

(21) Appl. No.: 17/283,072

(22) PCT Filed: Oct. 19, 2019

(86) PCT No.: PCT/US2019/057101
§ 371 (c)(1),
(2) Date: Apr. 6, 2021

(87) PCT Pub. No.: WO2020/082055
PCT Pub. Date: Apr. 23, 2020

(65) Prior Publication Data

US 2021/0378335 A1 Dec. 9, 2021

Related U.S. Application Data

(60) Provisional application No. 62/748,136, filed on Oct. 19, 2018.

(51) Int. Cl.
*A41D 31/10* (2019.01)
*A41D 19/015* (2006.01)

(52) U.S. Cl.
CPC ..... *A41D 19/01505* (2013.01); *A41D 31/10* (2019.02)

(58) Field of Classification Search
CPC ..... A41D 19/0065; A41D 19/01547; A41D 19/00; A41D 19/01505; A41D 31/10; A41D 19/01523
See application file for complete search history.

(56) References Cited

U.S. PATENT DOCUMENTS 3,953,566 A * 4/1976 Gore ..... H01B 3/445 264/289.3
5,732,413 A * 3/1998 Williams ..... A41D 19/001 2/168

(Continued)

FOREIGN PATENT DOCUMENTS

CN 101060978 A 10/2007
CN 103997923 A 8/2014

(Continued)

OTHER PUBLICATIONS

"The revised EN388 standard: what's changing, why, and what to look for", "https://www.hexarmor.com/posts/revised-en388-standards-explained" (Year: 2017).*

(Continued)

*Primary Examiner* — Jillian K Pierorazio
(74) *Attorney, Agent, or Firm* — Moser Taboada

(57) ABSTRACT

A liquid proof glove having impact protection comprises an outer glove portion comprising an outer fabric layer having an inner surface and an outer surface, a polymeric coating adhered to the outer surface of the outer fabric layer, and at least one protective structure adhered to at least one of the polymeric coating or outer fabric layer, or both. The glove further comprises an inner glove portion comprising an inner fabric layer having an outer surface and an inner surface and a liquid proof barrier layer adhered to the outer surface of the inner fabric layer. The liquid proof barrier layer is adhered to the inner surface of the outer fabric layer to join the inner glove portion to the outer glove portion.

19 Claims, 7 Drawing Sheets

(56) References Cited

U.S. PATENT DOCUMENTS

2009/0070916 A1* 3/2009 Kassam ..... A41D 19/01505 2/164
2010/0071114 A1* 3/2010 Jaeger ..... A41D 19/01523 2/163
2011/0203027 A1* 8/2011 Flather ..... B32B 25/08 2/48
2013/0091618 A1* 4/2013 Tanaka ..... A41D 19/01558 2/161.8
2013/0232673 A1* 9/2013 Johnson ..... B32B 5/22 2/455
2013/0305430 A1* 11/2013 Tomono ..... A41D 19/01558 2/163
2014/0000006 A1* 1/2014 Perera ..... D06M 15/564 2/167
2014/0215685 A1* 8/2014 Bush ..... A63B 71/146 2/161.1
2015/0128324 A1* 5/2015 Baker ..... A41D 19/01523 2/169
2015/0135403 A1* 5/2015 Mercado ..... A41D 19/04 524/502
2015/0143608 A1* 5/2015 Loo ..... B29D 99/0067 2/169
2015/0143609 A1* 5/2015 Francisco Costa ..... A41D 19/0006 2/167
2015/0181954 A1* 7/2015 Koga ..... D06N 3/106 2/167
2015/0374052 A1* 12/2015 Pimentel de Oliveira ..... D06N 3/0009 2/161.6
2016/0037839 A1* 2/2016 Vandenbosch ... A41D 19/01576 2/457
2016/0120242 A1* 5/2016 Thompson ..... A41D 19/001 2/169
2016/0262469 A1* 9/2016 Fernando ..... D04B 1/28
2016/0360808 A1* 12/2016 Flather ..... A41D 19/0065
2017/0000201 A1* 1/2017 Flather ..... B29C 41/34
2017/0099890 A1* 4/2017 Koga ..... A41D 19/0082
2017/0112204 A1* 4/2017 Perera ..... A41D 19/01505
2017/0156421 A1* 6/2017 Lin ..... A41D 19/0065
2018/0027903 A1* 2/2018 Kim ..... B29C 51/264
2018/0049490 A1* 2/2018 Lim ..... A41D 19/01523
2018/0154622 A1* 6/2018 Howland ..... A41D 19/015
2018/0249773 A1* 9/2018 Isobe ..... A41D 19/0006

FOREIGN PATENT DOCUMENTS

CN 206651428 U 11/2017
KR 10-2013-0040351 A 4/2013
KR 10-2018-0089955 A 8/2016
KR 10-1809482 B1 12/2017
KR 20-2018-0002630 U 9/2018
WO WO 96/27306 A1 9/1996
WO WO-2017117193 A1 7/2017

OTHER PUBLICATIONS

International Search Report for PCT/US2019/057101 dated Feb. 27, 2020.
Supplemental European Search Report for Application No. 19873848.6, dated Jul. 7, 2022, 7 pgs.

* cited by examiner

LIQUID PROOF GLOVES HAVING IMPACT PROTECTION

CROSS-REFERENCE TO RELATED APPLICATIONS

This application claims the benefit of priority to U.S. Provisional Patent Application No. 62/748,136 filed on Oct. 19, 2018, which is incorporated herein by reference in its entirety.

BACKGROUND

Field

Embodiments of the present invention generally relate to gloves and, more particularly, to supported gloves having an elastomeric, polymeric, or latex coating, liquid proof structure and impact protection features disposed thereon, and a method of making the gloves.

Description of the Related Art

Gloves are utilized in many fields for protecting workers, such as medical, industrial, household, and others. In service, gloves are subjected to extensive wear from cuts, punctures, and abrasions, creating a need for durability. Furthermore, other in-service requirements include enhanced impact resistance, grip-ability, and flexibility. Many gloves comprise fabrics and/or leathers as well as fabric/leather patches, which are bulky and expensive.

Supported gloves consist of a fabric liner that is dipped into a rubber polymer, e.g., natural rubber latex, synthetic rubber latex, and the like, forming a coating that covers at least a portion of the fabric liner. However, such gloves may not offer adequate strength in regions that may experience stress or impact. Further, such gloves may be required to maintain a high amount of dexterity for the wearer, and may also need to be impermeable to liquids, or liquid proof.

Therefore, there is a need in the art for a supported glove having impact protection in specific regions of the glove, while providing enhanced grip and being liquid proof in desired regions of the glove, and a method of producing such a glove.

SUMMARY

Gloves comprising polymeric coating(s) disposed on a fabric liner, impact protection elements disposed on a part(s) of the polymeric coating(s) or part(s) of the fabric liner, liquid proof layer to prevent liquid permeability across the gloves, and method of making the gloves, in accordance with the present invention, substantially as shown in and/or described in connection with at least one of the figures, as set forth more completely in the claims, are disclosed. Various advantages, aspects, and novel features of the present disclosure, as well as details of an exemplary embodiment thereof, will be more fully understood from the following description and drawings.

The foregoing summary is not intended, and should not be contemplated, to describe each embodiment or every implementation described in the disclosure. Other and further embodiments of the present invention are described below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. It is to be understood that elements and features of one embodiment may be in other embodiments without further recitation and that, where possible, identical reference numerals have been used to indicate comparable elements that are common to the figures.

DETAILED DESCRIPTION

Embodiments of the present invention generally relate to a protective glove that is liquid proof and provides impact protection. and method(s) of making such gloves. According to various embodiments, the gloves disclosed herein include protective structures, such as blocks made from thermoplastic rubber (TPR), to protect areas of the wearer's hand from impact injuries, such as those that may be sustained from contact with industrial or other work equipment. In some embodiments, the gloves also include protective and enhanced grip coatings on an outer fabric liner or layer, such as coatings comprising one or more nitrile materials having a rough surface, to protect areas of the wearer's hand from chemical reagents, while providing enhanced grip. In some embodiments, the gloves also include a liquid proof barrier layer in at least a portion or the entirety of the glove to prevent liquid permeability therethrough. In some embodiments, the gloves include an inner fabric layer, such as a liner made of cotton inside the liquid proof barrier, for wearer's comfort. While providing one or more of the various features disclosed hereinabove, the gloves allow for flexibility and agility for the user.

Figure 1A:
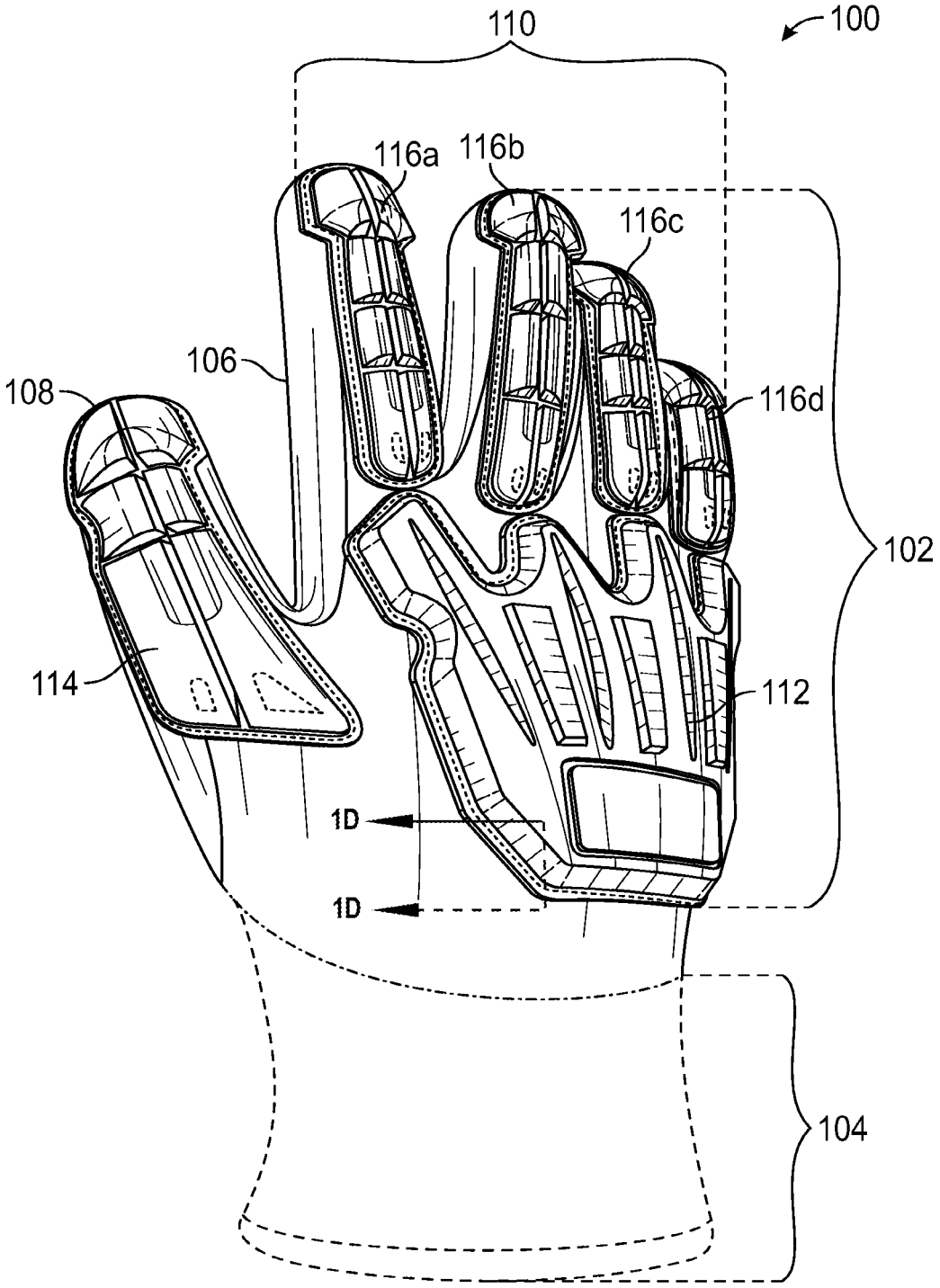
FIG. 1A is a perspective view of a protective glove, in accordance with one or more embodiments of the invention.
Figure 1B:
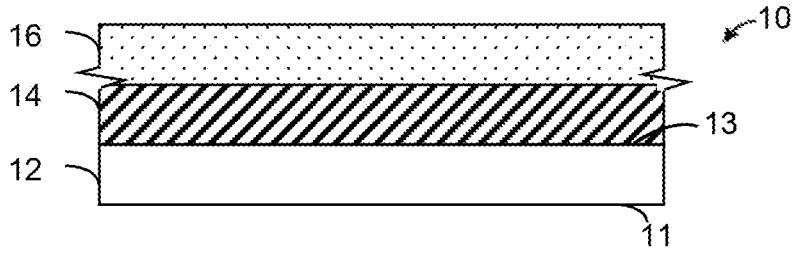
FIG. 1B is a cross-sectional view of an outer glove portion of the protective glove of FIG. 1A, in accordance with one or more embodiments of the invention.
Figure 1C:
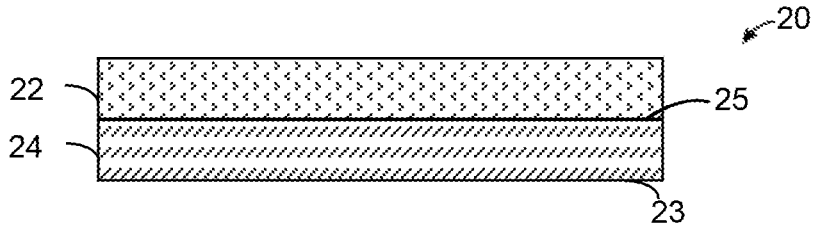
FIG. 1C is a cross-sectional view of an inner glove portion of the protective glove of FIG. 1A, in accordance with one or more embodiments of the invention.
Figure 1D:
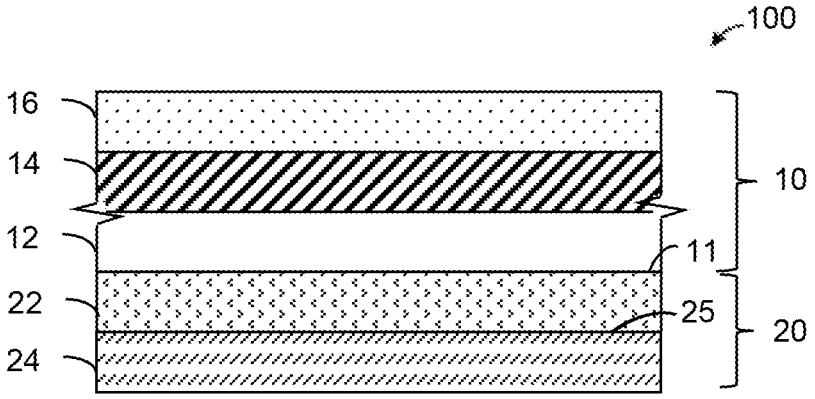
FIG. 1D is a cross-sectional view of the protective glove of FIG. 1A, in accordance with one or more embodiments of the invention.

FIG. 1A is a perspective view of a protective glove 100, FIG. 1B is a cross-sectional view of an outer glove portion 10 of the glove 100, FIG. 1C is a cross-sectional view of an inner glove portion 20 of the glove 100, FIG. 1D is a cross-sectional view of the glove 100 along the section 1D-1D formed by bonding the outer glove portion and the inner glove portion, in accordance with one or more embodiments. For best understanding, FIGS. 1A-1D should be viewed simultaneously while reading the following description.

The outer glove portion 10 comprises an outer fabric layer 12 having an inner surface 11 and an outer surface 13, a polymeric coating 14, and one or more protective structures 16 (also referred to as bumpers). The polymeric coating 14 is positioned between the outer fabric layer 12 and the protective structures 16.

In some embodiments, the outer fabric layer 12 is made from a yarn comprising natural and/or synthetic fibers. In some embodiments, the outer fabric layer 12 is made from a cut resistant yarn which comprises, for example, high performance poly ethylene (HPPE), steel fibers, glass fiber and combinations thereof to provide cut resistance to the entire glove. In some embodiments, the conductive yarn comprises stainless steel. In some embodiments, a conductive yarn is knit into the finger and thumb tips, and/or conductivity is otherwise provided (e.g. by including a conductive material coating) for providing touch screen capability, for both capacitive and resistive touchscreens.

In some embodiments, the polymeric coating 14 comprises a protective nitrile coating. The protective coating is configured to provide cut resistance (CE EN388:2016: level D, ANSI/ISEA105:2016: level A4), puncture resistance (CE EN388:2016: level 3), and/or abrasion resistance (CE EN388:2016: level 4) on palm area. Additionally, in some embodiments, the nitrile coating may be treated to include a rough surface texture to provide enhanced grip, for example, a "salt" grip. In some embodiments, the rough surface texture is provided at least on the palm area and over the thumb and finger tips for enhanced tactile grip and dexterity. In some embodiments, the polymeric coating 14 is red in color.

In some embodiments, the protective structures 16 are formed from thermoplastic rubber (TPR) material, and have a thickness of, for example, about 6 mm on areas above knuckles, fingers, and thumb, and about 2-5 mm above the metacarpal bones. In some embodiments, the protective structures 16 have a hardness/softness of about 30-40 shore A. Other materials, construction, heights, and durability, among other characteristics, may be used for the construction of the protective structures without departing from the scope and spirit of the present invention, as embodied in the claims appended hereto. The protective structures 16 (represented by 112, 114, 116 in FIG. 1A) and are stitched on to a substrate of the outer fabric layer 12 and/or the polymeric coating 14 using a 100% nylon thread. In some embodiments, traditional stitching thread or yarn or thermoplastic rubber (TPR) stitching thread made of about 90% Nylon is used, and in some embodiments, stitching threads may include cotton, polyester, linen, rayon.

The inner glove portion 20 comprises a liquid proof barrier layer 22 and an inner fabric layer 24 having an inner surface 23 and an outer surface 25, and the inner surface 23 of the inner fabric layer 24 contacts a wearer's hand and wrist. In some embodiments, the inner fabric layer 24 is a knitted liner which comprises natural fibers (e.g., cotton) or synthetic fibers (e.g., nylon), or both. In some embodiments, the inner fabric layer 24 may optionally be treated with skin conditioners such as Aloe Vera, other skin hydrants, antibacterial agents, among others.

In some embodiments, the liquid proof barrier layer 22 comprises thermoplastic urethane (TPU), and the inner fabric layer 24 comprises cotton. In some embodiments, the liquid proof barrier layer 22 comprises polyurethane (PU), having a thermoplastic hot melt glue (not shown separately from the layer 22), as generally known in the art, disposed on both sides of the liquid proof barrier layer 22. In some embodiments, the liquid proof barrier layer 22 is 100% TPU, or 100% PU with hot melt glue disposed on both sides. In some embodiments, the layer 22 has a thickness between about 1 to about 3 mm, and in some embodiments, the layer 22 has a thickness between about 0.1 to about 1 mm. The material of the liquid proof barrier layer 22 is suitable for heat bonding, that is, when heated, the material of the liquid proof barrier layer 22 bonds to material in contact with the liquid proof barrier layer 22.

In some embodiments, the liquid proof barrier layer 22 may be chemical resistant, such that harmful chemicals do not penetrate the barrier layer, or penetrate the barrier layer slowly. Such a barrier may be used in combination with a TPU layer or a PU layer, or may be adhered to the inner fabric layer 24 using an adhesive.

The glove 100 is produced by heat bonding the outer glove portion 10 and the inner glove portion 20 at the liquid proof barrier layer 22. Specifically, the liquid proof barrier layer 22 heat bonds to the inner surface 11 of the outer fabric layer 12 on a first side, and to the outer surface 25 of the inner fabric layer 24 on a second side opposite the first side, as clearly seen in FIG. 1D.

As shown in FIG. 1A, the glove 100 produced by heat bonding the outer glove portion 10 and the inner glove portion 20, includes a hand-receiving portion 102 and a wrist portion 104 extending from hand-receiving portion 102. The hand-receiving portion 102 is shaped to generally conform to a human hand and includes a dorsal side, a palm side 106, a thumb pocket 108, and four finger pockets 110. The illustrated thumb pocket 108 and finger pockets 110 cover the digits entirely, but embodiments of the disclosed glove may be provided that cover only a portion of the thumb and fingers. The wrist portion 104 is integrally formed with the hand-receiving portion 102 and has a length suitable for covering at least a portion of the wearer's lower arm, extending upward of the wearer's wrist.

The glove 100 also includes protective structures on the dorsal side of the glove 100. The glove 100 includes a first protective structure 112 on the dorsal side of the glove that protects the bones from impact on the backhand of a palm. For example, the protective structure 112 covers a region corresponding to at least a part of the index finger metacarpal bone, and at least part of the other metacarpal bones. The glove 100 further includes a second protective structure 114 on the dorsal side of the glove that protects at least part of the pollex (i.e., thumb metacarpal bone). As illustrated, the second protective structure 114 is separate and distinct from the first protective structure 112, and includes a number of protrusions on a common base layer. The glove 100 may further include protective structures 116*a*, 116*b*, 116*c*, and

116*d* that protect the proximal phalanges, the intermediate phalanges, and the distal phalanges. In this example, protective structures 116*a* to 116*d* (collectively, 116) are flexible structures that have multiple protrusions to protect the finger bones while allowing movement of the finger bones.

The protective structures (112, 114, 116 in FIG. 1A, represented by 16 in FIGS. 1B and 1D) are configured to protect portions of the hand without unduly hampering hand motion and dexterity. In some embodiments, the protective structures 112, 114, 116 comprise a generally even layer of material extending from a base of such protective structure(s), slit-like features (lack of material), and protrusions (additional material) disposed in the even layer. The patterns of slit-like features and protrusions are made according to regions in which flexibility is needed (lack of material) and regions in which additional impact protection is needed (additional material). For example, protrusions may be spaced apart so that spaces between protrusions are arranged over joints or over areas that bend, flex, articulate, or otherwise move. The protrusions may have various shapes, heights, and arrangements. For example, the perimeters of the protrusions may substantially be in the shape of triangles, rectangles, parallelograms, trapezoids, and other geometric shapes. Particular shapes may be chosen based on the motion of different portions of the hand. The glove 100 as described above is liquid proof, provides impact protection, protection from chemical reagents and superior grip properties.

Figure 2:
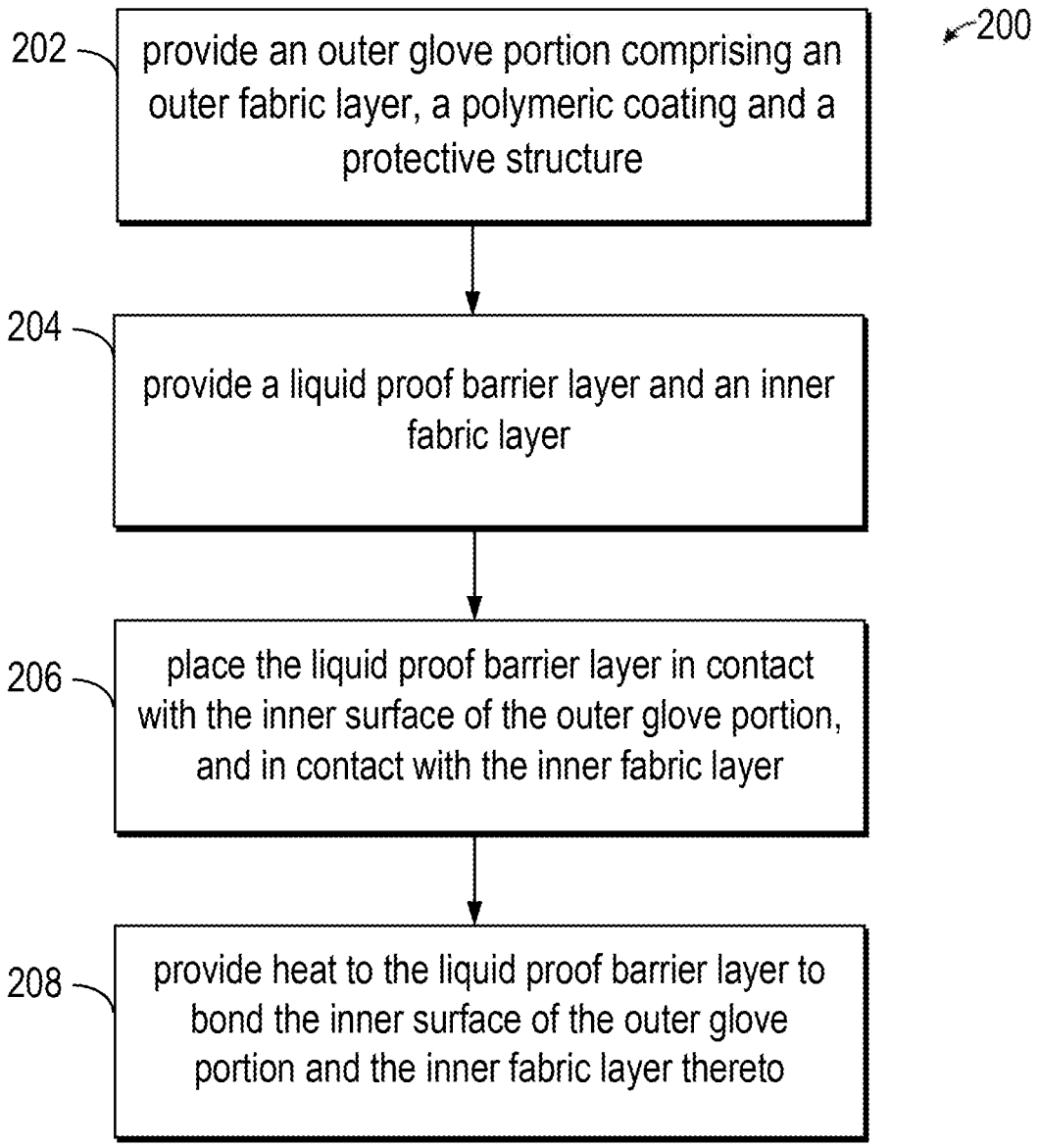
FIG. 2 is a flow chart of a method of manufacturing a protective glove having liquid proofing, in accordance with one or more embodiments of the invention.

FIG. 2 is a flow chart illustrating an exemplary method 200 for manufacturing a liquid proof glove having impact protection, such as such as the glove 100 illustrated in FIGS. 1A-1D, in accordance with one or more embodiments of the disclosure. In some embodiments, the method 200 utilizes protective gloves as generally known in the art, to generate liquid proof protective gloves. At step 202, the method 200 comprises providing an outer glove portion, for example, the outer glove portion 10, comprising an outer fabric layer, a polymeric coating and protective structures disposed thereon. According to some embodiments, the outer glove portion is a pre-fabricated glove, for example, 065 R-Flex Impact Nitrile Impact Gloves made by RINGERS GLOVES USA of Houston, Texas.

At step 204, the method 200 comprises providing a liquid proof barrier layer, for example, the liquid proof barrier layer 22, and an inner fabric layer, for example the inner fabric layer 24. At step 206, the method 200 comprises placing the liquid proof barrier layer inside the outer glove portion, that is, the liquid proof barrier layer is placed in contact with the inner surface of the outer fabric layer of the outer glove portion on a first side of the liquid proof barrier layer. Further, the liquid proof barrier layer is also placed to be in contact with the outer surface of the inner fabric layer on a second side of the liquid proof barrier layer opposite the first side.

At step 208, the method 200 includes providing heat to the liquid proof barrier layer, to bond the inner surface of the outer fabric layer of the outer glove portion on the first side of the liquid proof barrier, and the outer surface of the inner fabric layer to the second side of the liquid proof barrier layer. In some embodiments, the heat is provided by a hand shaped former, over which the outer glove portion, the liquid proof barrier layer and the inner fabric layer are disposed. The former comprises heating elements, which when heated, heat the former and any material disposed on the former. In some embodiments, for example, as explained further below, heat is provided by heating the protective structures of the outer glove portion, in some embodiments, heat is provided by heating the inner fabric liner. In some embodiments, heat is provided by heating both the inner fabric liner and the protective structures. The heat is then conducted (from the protective structures or the inner fabric liner) to the liquid proof barrier layer, which then heat bonds with the outer fabric layer and the inner fabric layer.

Figure 3A:
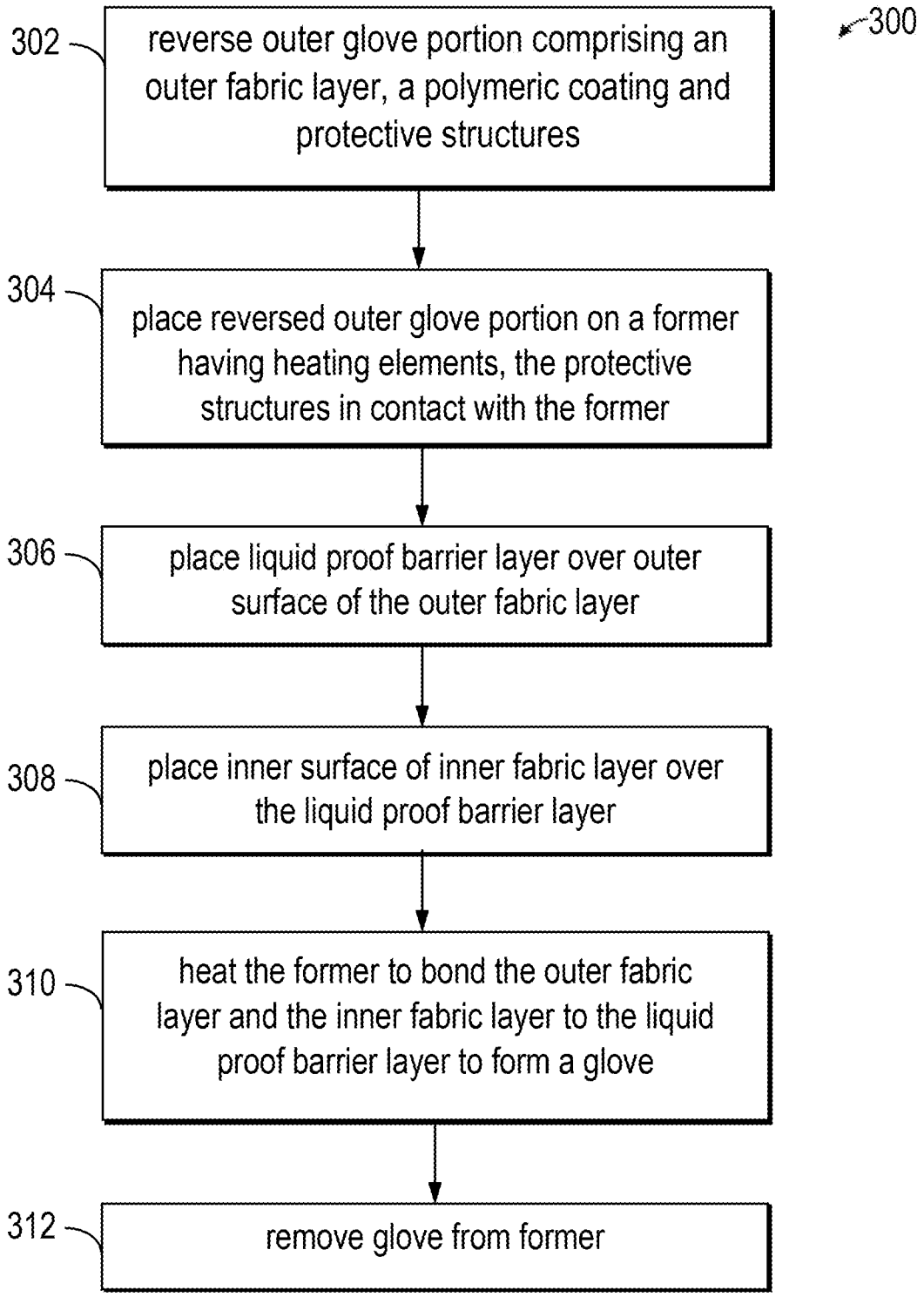
FIG. 3A is a flow chart of a method of manufacturing a protective glove having liquid proofing, in accordance with one or more embodiments of the invention.
Figure 4A:
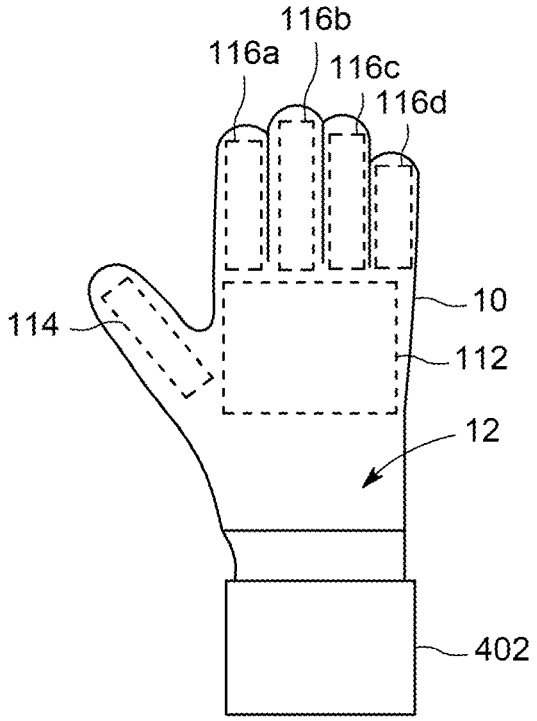
FIG. 4A illustrates the outer glove portion of FIG. 1B fitted to a former in a reversed configuration, in accordance with one or more embodiments of the invention.

FIG. 3A is a flow chart of a method 300 of manufacturing a liquid proof glove having impact protection, in accordance with one or more embodiments. FIGS. 4A-4E illustrate the method 300 schematically, and are referred to in the following description thereof. At step 302, the method 300 comprises reversing an outer glove portion. In the reversed configuration, as seen in FIG. 4A, the outer glove portion 10 is turned inside out, such that the protective structures (112, 114, 116, shown in broken lines) are on the inside and the outer fabric layer 12 is on the outside, as seen in FIG. 4A. At step 304, the method 300 includes placing the reversed outer glove portion 10 on a hand shaped former, such as a former 402 of FIG. 4A. The former 402 includes heating elements (not shown) therein to heat the former 402, and in some embodiments, the former 402 is a metal structure. In the reversed configuration, the protective structures (112, 114, 116) contact the former 402, and the outer surface of the outer fabric layer forms the outermost layer of the outer glove portion 10 mounted on the former 402.

Figure 4B:
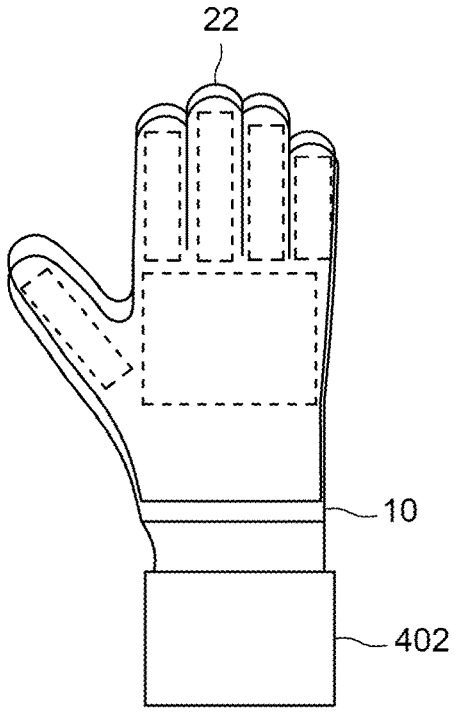
FIG. 4B illustrates a liquid proof barrier layer fitted over the reversed outer glove portion of FIG. 4A, in accordance with one or more embodiments of the invention.

At step 306, the method 300 comprises placing a liquid proof barrier layer, for example, the liquid proof barrier layer 22, over the outer surface of the outer fabric layer of the outer glove portion 10, for example, as seen in FIG. 4B. In some embodiments, the liquid proof barrier layer 22 is either a TPU layer or a PU layer with hot melt glue on both sides. The hand-shaped liquid proof barrier layer 22 overlaps with the outer glove portion, and spans the entirety of the first fabric liner. In FIG. 4B, the outline of the layer 22 is shown offset from the outer glove portion 10 for ease of illustration, however, as discussed above, it is understood that the layer 22 covers the outer glove portion 10, including the fingers, thumb, palm and backhand of the palm region.

Figure 4C:
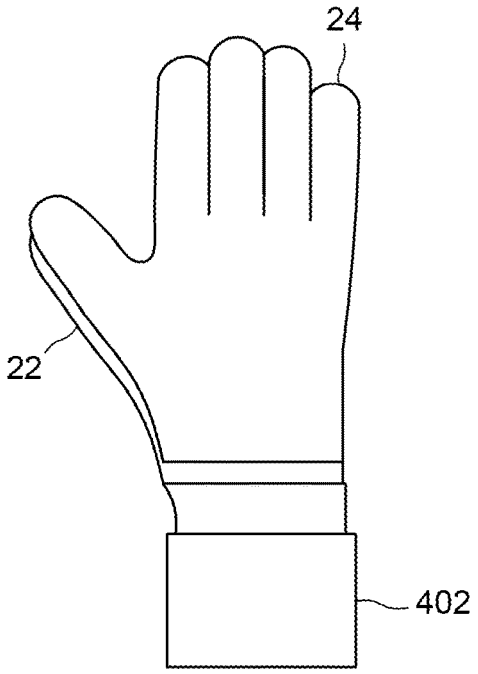
FIG. 4C illustrates an inner fabric layer fitted over the liquid proof barrier layer of FIG. 4B, in accordance with one or more embodiments of the invention.

At step 308, the method 300 comprises placing a hand shaped inner fabric layer, for example, the inner fabric layer 24, over the liquid proof barrier layer 22, as seen in FIG. 4C. The outer surface 25 of the inner fabric layer 24 contacts the layer 22, and the inner surface 23 of the inner fabric layer 24 is configured to contact the wearer's hand, to provide a comfortable interface to the wearer's hands. The hand-shaped inner fabric layer 24 overlaps with the hand-shaped liquid proof barrier layer 22, and spans the entirety of the liquid proof barrier layer 22. In FIG. 4C, the outline of the inner fabric layer 24 is shown offset from the liquid proof barrier layer 22 for ease of illustration, however, as discussed above, it is understood that the inner fabric layer 24 covers the liquid proof barrier layer 22, including the fingers, thumb, palm and backhand of the palm region.

Figure 4D:
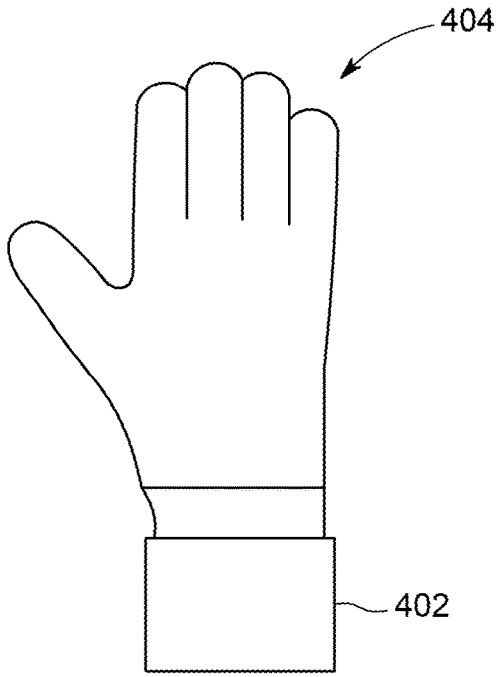
FIG. 4D illustrates the glove of FIG. 1A formed by heat treatment on the former, in accordance with one or more embodiments of the invention.

At the end of step 308, the method 300 yields a multi-layer structure 404 mounted on the former 402, as seen in FIG. 4D. The multi-layer structure 404 includes the reversed outer glove portion 10, with protective structures (112, 114, 116) in contact with the former 402, the liquid proof barrier layer 22 over and in contact with the outer fabric layer 12 of the outer glove portion 10, and the inner fabric layer 24 over and in contact with the liquid proof barrier layer 22.

Figure 4E:
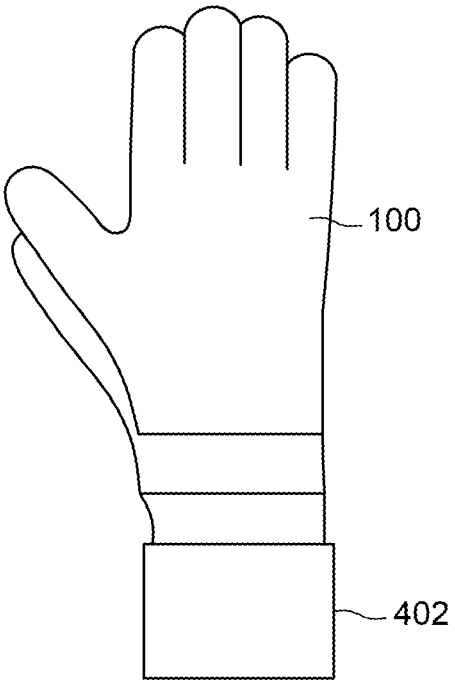
FIG. 4E illustrates the glove of FIG. 1A as it is being removed from the former, in accordance with one or more embodiments of the invention.
Figure 4F:
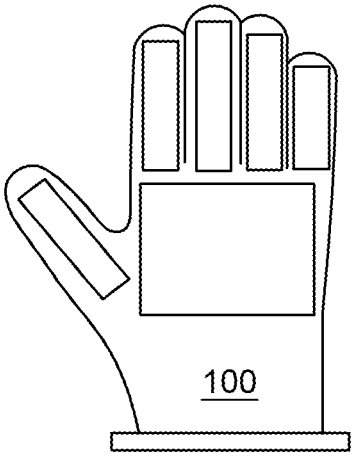
FIG. 4F illustrates the glove of FIG. 1A having a multi-layer liquid-proof structure, removed from the former and straightened, in accordance with one or more embodiments of the invention.

At step 310, the method 300 comprises heating the former 402, for example using heating elements provided in the former 402, for applying heat treatment to the multi-layer structure 404 of FIG. 4D, disposed on the former 402. The heat treatment includes heating the former, and thereby the multi-layer structure to a temperature, for a duration of time, to heat bond the outer glove portion 10 to the liquid proof barrier layer 22, and the inner fabric liner 24 to the liquid proof barrier layer 22. Specifically, the application of heat causes the material of the liquid proof barrier layer 22, for example TPU material, or the hot melt glue disposed on the PU material, to bond to the two surrounding materials, that is, the outer fabric layer 12 and the inner fabric layer 24, yielding a bonded, liquid-proof, multi-layer glove 100, as shown in FIG. 4E. The glove 100 so manufactured is in a reversed (inside out) configuration when still mounted on the former 402. At step 312, the method 300 comprises removing the glove from the former 402. FIG. 4E shows the glove 100 being removed from the former 402, and the thumb of the glove 100 is shown offset from the former 402 to represent removal of the glove 100 from the former 402. FIG. 4F shows the removed glove 100, reversed back to an outside-in configuration, similar to the configuration of FIG. 1A, that is, the configuration in which the glove 100 is worn.

While the method 300 describes embodiments of manufacturing the glove 100 in which the outer glove portion 10 is disposed on the former 402 in a reversed configuration, and then the inner glove portion (i.e., the liquid proof barrier layer and the inner fabric layer) are disposed thereon, in some embodiments, an alternate configuration for manufacturing the glove 100 is used.

Figure 3B:
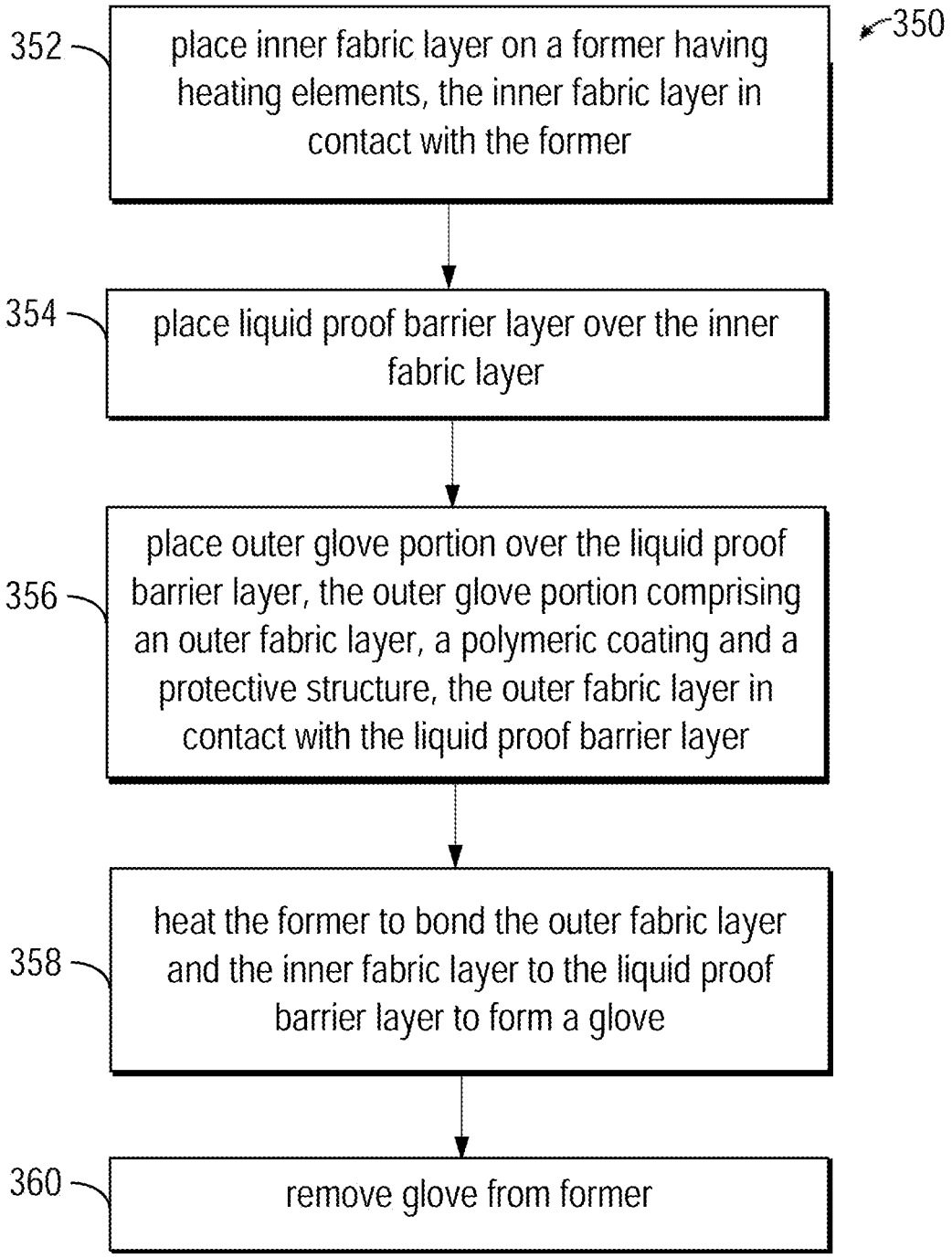
FIG. 3B is a flow chart of a method of manufacturing a protective glove having liquid proofing, in accordance with one or more embodiments of the invention.

For example, FIG. 3B is a flow chart of a method 350 of manufacturing a liquid proof glove having impact protection, in accordance with one or more embodiments. At step 352, the method 350 comprises placing the inner fabric layer 24 over the former 402, and the inner surface 23 of the inner fabric layer 24 is in direct contact with the former 402.

At step 354, the method 350 comprises placing the liquid proof barrier layer 22 is disposed over the inner fabric layer 24, and the liquid proof barrier layer 22 is in contact with the outer surface 25 of the inner fabric layer 24. In some embodiments, the liquid proof barrier layer 22 is either a TPU layer or a PU layer with hot melt glue on both sides.

At step 356, the method 350 comprises placing the outer glove portion 10 on, and in contact with, the liquid proof barrier layer 22, such that the inner layer 11 of the outer fabric layer 12 contacts the liquid proof barrier layer 22. In this manner, at the end of step 356, a multi-layer structure is disposed on the former 402. The multi-layer structure so obtained is similar in composition to the multi-layer structure 404 of FIG. 4D, and is disposed in a normal configuration, that is, with the protective structures on the outside, and the inner fabric layer 24 on the inside, and in contact with the former 402.

At step 358, the method 300 comprises heating the former 402, for example using heating elements provided in the former 402, for applying heat treatment to the multi-layer structure disposed on the former 402 at the end of step 356. The heat treatment includes heating the former, and thereby the multi-layer structure to a temperature, for a duration of time, to heat bond the outer glove portion 10 to the liquid proof barrier layer 22, and the inner fabric liner 24 to the liquid proof barrier layer 22. Specifically, the application of heat causes the material of the liquid proof barrier layer 22, for example TPU material, or the hot melt glue disposed on the PU material, to bond to the outer fabric layer 12 and the inner fabric layer 24, yielding a bonded, liquid-proof, multi-layer glove 100. At step 360, the method 350 comprises removing the glove 100 from the former 402.

In some embodiments, the glove so obtained from the methods 300 or 350 is further processed by trimming cuff edges and sewing the cuff edges, further securing the inner fabric layer, the liquid proof barrier layer and the outer glove portion.

In some embodiments, the outer glove portion 10 and the inner fabric layer 24 are optionally subjected to water or liquid resistance treatment, using techniques known in the art, before or after processing by the method 300 or 350. The glove 100, so treated would not soak liquid after being exposed to liquids, allowing the glove 100 (outer fabric layer and the inner fabric layer) to stay lightweight even after the glove 100 is exposed to liquids. The water or liquid resistance treatment also prevents liquids from seeping to the cuff edge, and to the inside of the glove 100.

The glove 100 so obtained is flexible (first fabric liner), provides chemical protection (nitrile coating), enhanced grip (salt grip), impact protection (protective structures or bumpers) and liquid-proofing (PU or TPU barrier layer), and comfort (cotton liner). The glove 100 provides superior protection in industrial environments while promoting dexterity and comfort for the wearer's hand. While FIG. 1A illustrates a specific design of the glove, other designs with differently shaped protective structures, polymeric coating, without polymeric coating, and other different configurations are contemplated herein, within the scope and spirit of the invention as defined by the claims appended hereto.

Reference throughout this specification to "one embodiment," "certain embodiments," "some embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in some embodiments," "in one embodiment" or "in an embodiment" in various places throughout this specification are not necessarily referring to the same embodiment of the invention. Furthermore, the particular features, structures, materials, or characteristics may be combined in any suitable manner in any one or more of the embodiments. Also, it is to be understood that polymeric, elastomeric, and latex are used interchangeably herein with respect to polymeric coatings and raised features made from polymeric compositions.

While the foregoing is directed to embodiments of the present invention, other and further embodiments of the invention may be devised without departing from the basic scope thereof, and the scope thereof is determined by the claims that follow.

I claim:

1. A supported glove comprising:

an outer glove portion comprising an outer fabric layer having an inner surface and an outer surface, a polymeric coating adhered to the outer surface of the outer fabric layer, and at least one protective structure adhered to at least one of the polymeric coating or outer fabric layer, or both; and an inner glove portion comprising an inner fabric layer having an outer surface and an inner surface and a liquid proof, non-breathable barrier layer, comprised of at least one of thermoplastic urethane (TPU) or polyurethane (PU) having thermal adhesive on opposite sides of the liquid proof barrier layer, adhered to the outer surface of the inner fabric layer, wherein the liquid proof barrier layer is impermeable to liquids, and wherein the liquid proof barrier layer is adhered to the inner surface of the outer fabric layer to join the inner glove portion to the outer glove portion.

2. The supported glove of claim 1, wherein the inner fabric layer consists essentially of cotton.

3. The supported glove of claim 1, wherein the polymeric coating has a rough surface texture.

4. The supported glove of claim 1, wherein the polymeric coating comprises a first nitrile material, and wherein the polymeric coating covers a surface of a palm of the glove.

5. The supported glove of claim 1, wherein a surface of a palm provides at least one of CE EN388:2016 level 4 puncture resistance, CE EN388:2016 level 4 abrasion resistance or NSI/ISEA105:2016: level A6 cut resistance.

6. The supported glove of claim 1, wherein the at least one protective structure has a thickness between about 2 mm to about 5 mm above metacarpal bones, a thickness of about 6 mm above knuckles, fingers and thumb, and a softness of about 30 duro shore A to about 40 duro shore A.

7. The supported glove of claim 6, wherein the at least one protective structure is flexible and includes regions which have less or no material.

8. The supported glove of claim 1, wherein the outer fabric layer comprises:

a high performance poly ethylene (HPPE); and at least one of glass fiber over the entire hand to impart cut resistance, or a conductive material in at least a region corresponding to tips of at least one of the fingers or the thumb.

9. The supported glove of claim 1, wherein the at least one outer protective structure extends on a dorsal side of the glove and extends along a thumb pocket or finger pocket of the glove, wherein the thumb or finger pocket extends longitudinally from a proximal end to a distal end along a longitudinal axis and each outer protective structure has a first portion and a second portion located proximally with respect to the first portion, the first portion having a width measured transverse to the longitudinal axis that is greater than a width of the second portion, and wherein the first portion covers the distal end of the thumb pocket or the finger pocket.

10. The supported glove of claim 9, wherein the second portion extends from the first portion.

11. The supported glove of claim 1, wherein the at least one protective structure is flexible and has at least one groove extending longitudinally and in a transverse direction.

12. A method of fabricating a glove, the method comprising:

providing an outer glove portion, the outer glove portion comprising an outer fabric layer having an inner surface and an outer surface, a polymeric coating adhered to the outer surface of the outer fabric layer, and at least one protective structure adhered to at least one of the polymeric coating or outer fabric layer, or both;

providing an inner glove portion, the inner glove portion comprising an inner fabric layer having an outer surface and an inner surface, and a liquid proof barrier layer, comprised of at least one of thermoplastic urethane (TPU) or polyurethane (PU) having thermal adhesive on opposite sides of the liquid proof barrier layer, in contact with the outer surface of the inner fabric layer placing the liquid proof barrier layer of the inner glove portion in contact with the inner surface of the outer glove portion; and heating the outer glove portion and the inner glove portion to heat and melt the thermal adhesive and bond the inner glove portion to the outer glove portion to form the glove and render the liquid proof barrier layer non-breathable.

13. The method of claim 12, wherein the outer fabric layer of the outer glove portion is bonded to a first side of the liquid proof barrier, and wherein the inner fabric layer of the inner glove portion is bonded to a second side of the liquid proof barrier, the second side opposite the first side.

14. The method of claim 12, further comprising placing the inner glove portion and the outer glove portion over a former comprising heating elements, wherein, the heating is provided via the heating elements.

15. The method of claim 14, wherein the outer glove portion is placed on the former in a reversed configuration, the at least one protective structure in direct contact with the former, wherein the liquid proof barrier layer is placed over the reversed outer glove portion, and wherein the inner fabric layer is placed over the liquid proof barrier layer.

16. The method of claim 14, wherein the inner fabric layer is placed on the former with the inner surface of the inner fabric layer in direct contact with the former, wherein the liquid proof barrier is placed over and in contact with the outer surface of the inner fabric layer, and wherein the outer glove portion is placed over the liquid proof barrier layer with the inner surface of the outer fabric layer in direct contact with the liquid proof barrier layer.

17. The method of claim 12, wherein the inner fabric layer consists essentially of cotton, the outer fabric layer comprises a high performance poly ethylene (HPPE), optionally, glass fiber over the entire hand to impart cut resistance, and optionally, a conductive material in a region corresponding to tips of at least one of the fingers or the thumb, and wherein the liquid proof barrier layer comprises thermoplastic urethane (TPU).

18. The supported glove of claim 12, wherein the at least one outer protective structure extends on a dorsal side of the glove and extends along a thumb pocket or finger pocket of the glove, wherein the thumb or finger pocket extends longitudinally from a proximal end to a distal end along a longitudinal axis and each outer protective structure has a first portion and a second portion located proximally with respect to the first portion, the first portion having a width measured transverse to the longitudinal axis that is greater than a width of the second portion, and wherein the first portion covers the distal end of the thumb pocket or the finger pocket.

19. The supported glove of claim 12, wherein the at least one protective structure is flexible and has at least one groove extending longitudinally and in a transverse direction.

* * * * *